US005538458A

United States Patent [19]

Maier

[11] Patent Number: 5,538,458

[45] Date of Patent: Jul. 23, 1996

[54] DEVICE FOR GRINDING THE SURFACE OF A CYLINDER, IN PARTICULAR THE CYLINDER OF A PAPER MACHINE

[75] Inventor: Urs Maier, Winterthur, Switzerland

[73] Assignee: Farros Blatter AG, Winterthur, Switzerland

[21] Appl. No.: 256,727

[22] PCT Filed: Oct. 20, 1993

[86] PCT No.: PCT/CH93/00248

§ 371 Date: Jul. 21, 1994

§ 102(e) Date: Jul. 21, 1994

[87] PCT Pub. No.: WO94/12315

PCT Pub. Date: Jun. 9, 1994

[30] Foreign Application Priority Data

Nov. 25, 1992 [CH] Switzerland ..... 3614/92

[51] Int. Cl.[6] ..... B24B 49/02; B24B 21/02

[52] U.S. Cl. ..... 451/11; 451/304; 451/307

[58] Field of Search ..... 451/49, 11, 296, 451/304, 307, 424, 426

[56] References Cited

U.S. PATENT DOCUMENTS

| | | | |
|---|---|---|---|
| 2,195,064 | 3/1940 | Wallace | 451/49 |
| 2,579,391 | 12/1951 | Minarik et al. | 451/49 |
| 2,651,152 | 9/1953 | Schnuck . | |
| 3,264,749 | 8/1966 | Malmstrom et al. | 451/49 |
| 4,827,751 | 5/1989 | Holthoff | 451/49 |
| 5,371,975 | 12/1994 | Lundmark | 451/49 |

FOREIGN PATENT DOCUMENTS

| | | |
|---|---|---|
| 0359304 | 3/1990 | European Pat. Off. . |
| WO87/02281 | 4/1987 | WIPO . |

*Primary Examiner*—Timothy V. Eley
*Attorney, Agent, or Firm*—Burns, Doane, Swecker & Mathis

[57] ABSTRACT

A device for grinding a cylinder surface is provided, the cylinder being one of at least three substantially parallel, axially offset cylinders. The device includes a central body member and at least three supporting elements, each of the supporting elements being associated with a corresponding one of the cylinders, the supporting elements supporting the central body member relative to the cylinders. One or more belt grinder assemblies are provided, each belt grinder assembly including a belt grinder and a device for mounting the belt grinder on the central body member. Each belt grinder includes a contact wheel, an abrasive belt, extending around the contact wheel, and a device for supporting the contact wheel relative to a one of the cylinders to be ground. The supporting device includes a device for adjusting a position of the contact wheel relative to the one of the cylinders to be ground.

21 Claims, 8 Drawing Sheets

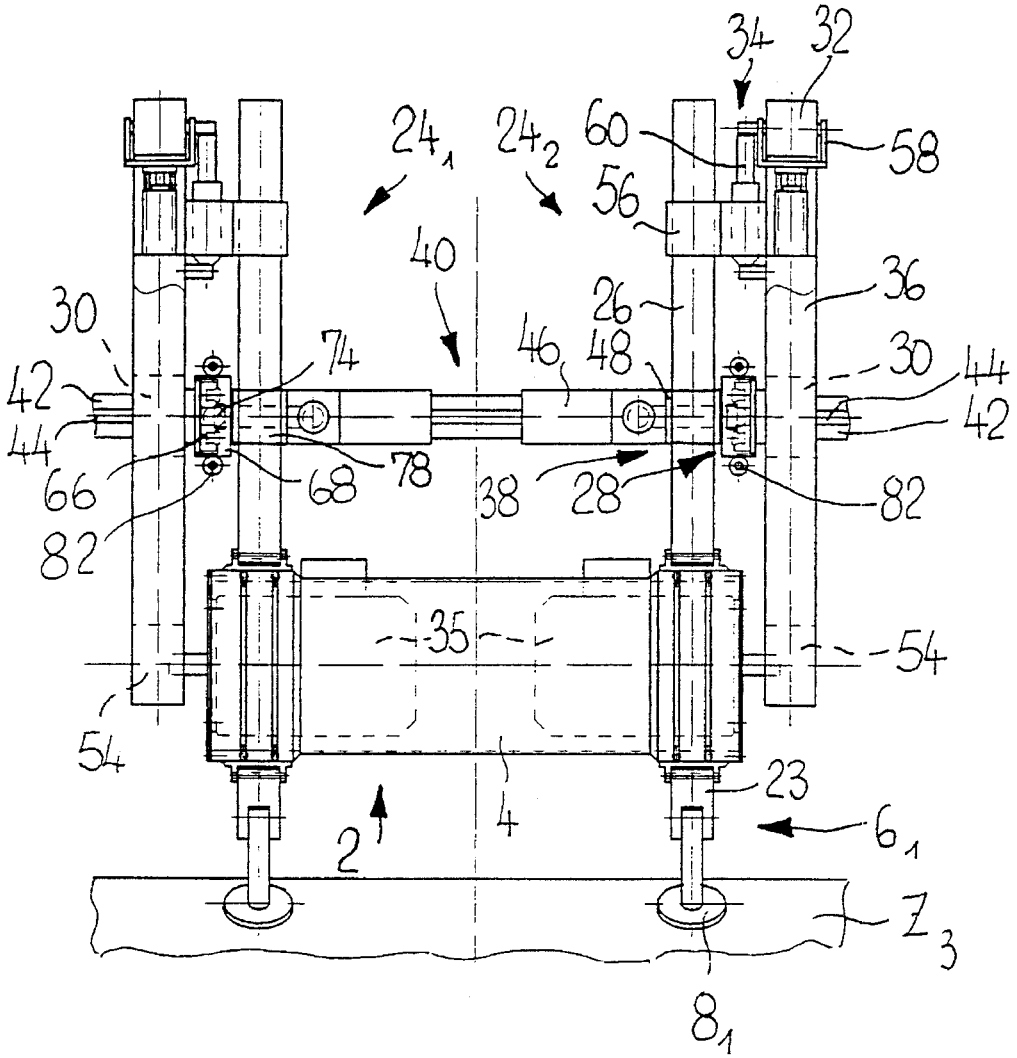
Fig.3
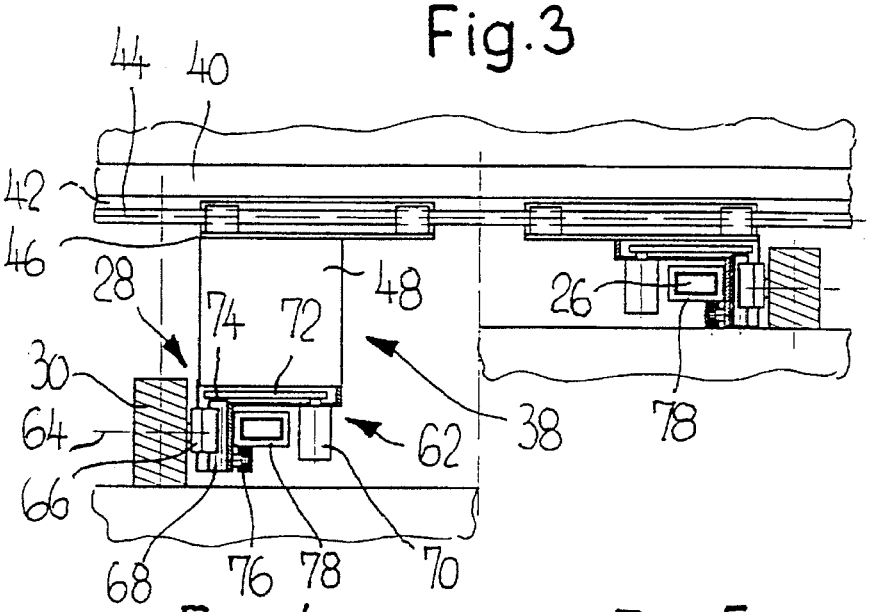
Fig. 4
Fig. 5

DEVICE FOR GRINDING THE SURFACE OF A CYLINDER, IN PARTICULAR THE CYLINDER OF A PAPER MACHINE

FIELD OF THE INVENTION

The present invention relates to a device for grinding the surface of a cylinder.

BACKGROUND AND SUMMARY OF THE INVENTION

Several such devices are known in the art, such as EP-OS 0 359 304. Disadvantages of these devices are that they require a special carrier which has to be arranged alongside the surface of the cylinder before each grinding operation in order to guide the belt grinder along the length of the cylinder surface. It is thus impossible to use such a grinding device between several cylinders located close together, and the corresponding cylinders must be dismantled in order to be ground.

An object of the present invention is to construct a grinding device of the generic type mentioned in the introduction in such a manner that it can be put into use between cylinders located close together.

By virtue of a mounting possessing three pairs of supporting members or struts arranged in a star shape, these members having foot pieces which can travel on a supporting base, the mounting can be introduced in between cylinders located close together and can rest on the surfaces of the cylinders so that no further carrier is necessary. The belt grinder includes a supporting arm, advantageously able to swivel, which is attached to the mounting or frame, and which carries a pillow block for the contact wheel which can be placed against the surface of the cylinder to be ground. The required applied pressure and distancing is ensured by a supporting device positioned between the pillow block and a supporting base, i.e., a cylinder. With the help of the grinding device the surface of cylinders located close together can be ground without these cylinders having to be dismantled.

A wide variety of driving methods are possible to ensure that the frame and hence also the grinding device can travel along the length of the cylinder surface. For example, a drive mechanism can be provided at the ends of the cylinder which moves the frame along the length of the cylinder surface by means of a traction line or a drive spindle.

The feet of the supporting members can have rollers or balls by means of which they rest on a supporting base, i.e., the surface of a cylinder. In accordance with one aspect of the present invention, a device is provided for grinding a surface of one cylinder of a machine having three parallel cylinders axially offset from one another. The device includes a frame having a central body, and a plurality of supporting members extending outwardly from the central body in positions to engage the cylinders. The supporting members are arranged to support the central body between the three cylinders. A belt grinder assembly is also provided and includes a belt grinder and means for mounting the belt grinder on the central body. The belt grinder includes a contact wheel and an abrasive belt extending around the contact wheel, and means for supporting the contact wheel relative to a one of the cylinders to be ground. The supporting means includes means for adjusting a position of the contact wheel relative to the cylinder that is to be ground.

BRIEF DESCRIPTION OF THE DRAWINGS

Several preferred embodiments of the present invention are illustrated in the attached drawings in which like numerals indicate similar elements and in which:

FIG. 3 is a cross-sectional view, taken along the line III—III in FIG. 1;

FIG. 4 is a partially cross-sectional view taken along the line IV—IV showing the contact wheel with a spacer in FIG. 1;

FIG. 5 is a partially cross-sectional view similar to that of FIG. 4 showing the contact wheel without a spacer;

FIGS. 1 and 2 show the overall view of a grinding device in various positions on three cylinders $Z_1$, $Z_2$, $Z_3$, the center arbors (axes) of which form a triangle, wherein the cylinder surfaces present a reciprocating radial distance $X_1$, $X_2$, $X_3$ of varying size. In particular the cylinders can be the cylinders of a paper machine.

Figure 1:
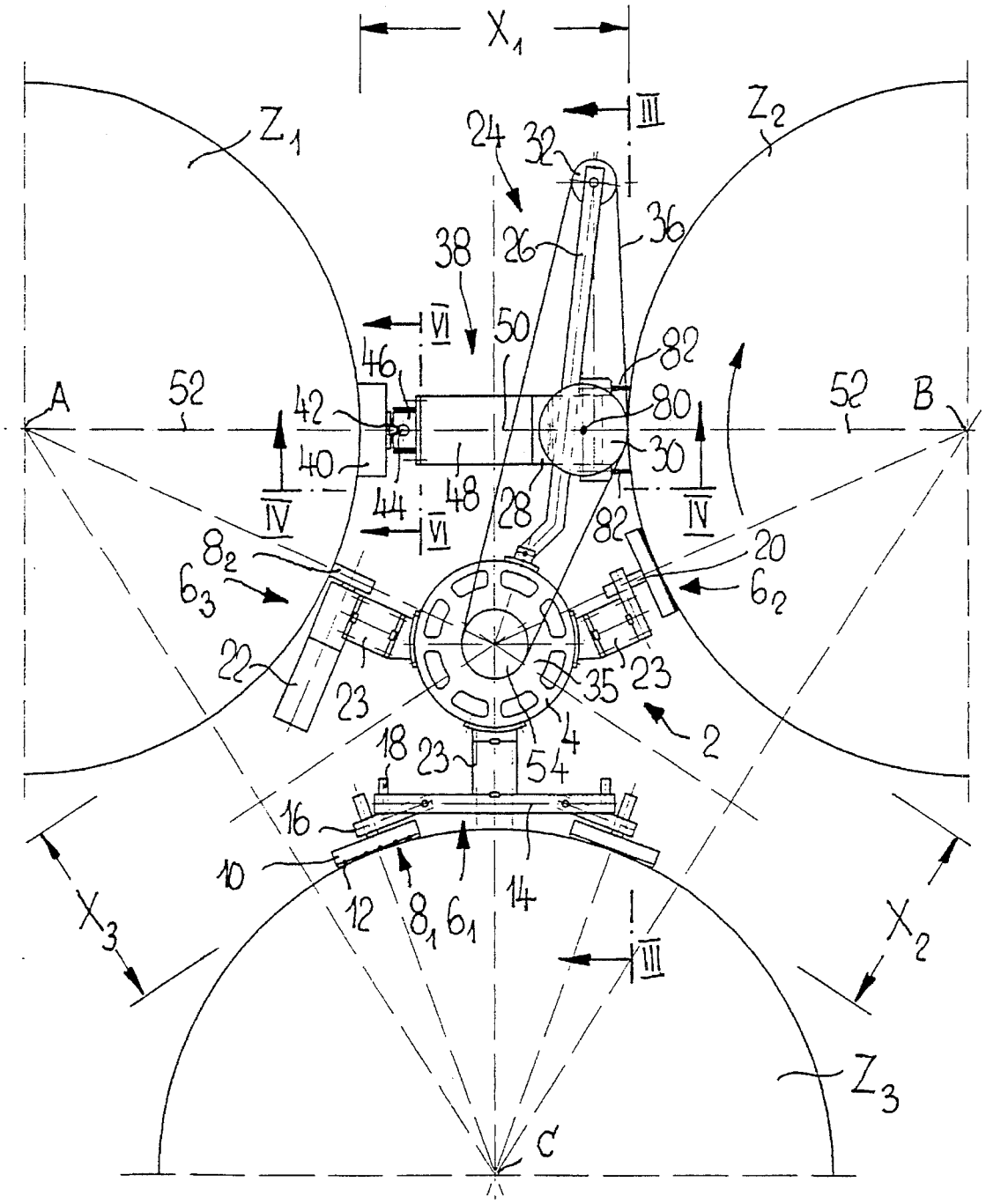
FIG. 1 is a schematic view of a grinding device according to a first embodiment of the present invention, the grinding device being shown between three cylinders, viewed across the direction of travel.

The grinding device includes a frame 2 with a central body 4 on which three supporting members $\mathbf{6}_1$, $\mathbf{6}_2$, $\mathbf{6}_3$ are arranged in pairs and in the shape of a star. The members $\mathbf{6}_1$ and $\mathbf{6}_2$ have feet $\mathbf{8}_1$ and $8_1$, respectively, and the member $\mathbf{6}_3$ has feet $\mathbf{8}_2$. The members rest, by means of the feet $\mathbf{8}_1$, $\mathbf{8}_2$, on a support base, i.e., the cylinders $Z_1$, $Z_2$, $Z_3$. The feet $\mathbf{8}_1$ are constructed as cushions 10, which have air exit orifices 12 to allow the exit of compressed air against the surface of the cylinder, thus forming an air cushion.

On the supporting member $\mathbf{6}_1$ two feet $\mathbf{8}_1$ are arranged on a crossbeam over a boom 16 in such a way that they can swivel and their position can be adjusted by means of a setscrew 18. The supporting member $\mathbf{6}_2$ has a foot $\mathbf{8}_1$ which can be adjusted by means of a threaded spindle 20.

The supporting member $\mathbf{6}_3$ is constructed as a drive mechanism and has a foot $\mathbf{8}_2$ which takes the form of a wheel which can be driven by a drive motor 22. The wheel $\mathbf{8}_2$ contacts the surface of the cylinder $Z_1$ and serves to move the grinding device alongside the cylinder parallel to the axis of the cylinder. Each supporting member $\mathbf{6}_1$, $\mathbf{6}_2$, $\mathbf{6}_3$ includes replaceable spacers 23 in order to allow the supporting members to be adapted to the individual distances $X_1$, $X_2$, $X_3$ from the cylinder surfaces.

On the frame 2 there is at least one belt grinder 24, preferably two belt grinders $\mathbf{24}_1$ and $\mathbf{24}_2$, each of which includes a bracket 26 hinged on the central body 4. The bracket 26 carries a pillow block 28 for a contact wheel 30 and a guide roller 32 with a tensioning device 34. The drive motor 35 of the belt grinder 24 is housed in the central body 4 and drives the abrasive belt 36 which lies over the contact wheel 30 and the guide roller 32.

Figure 2:
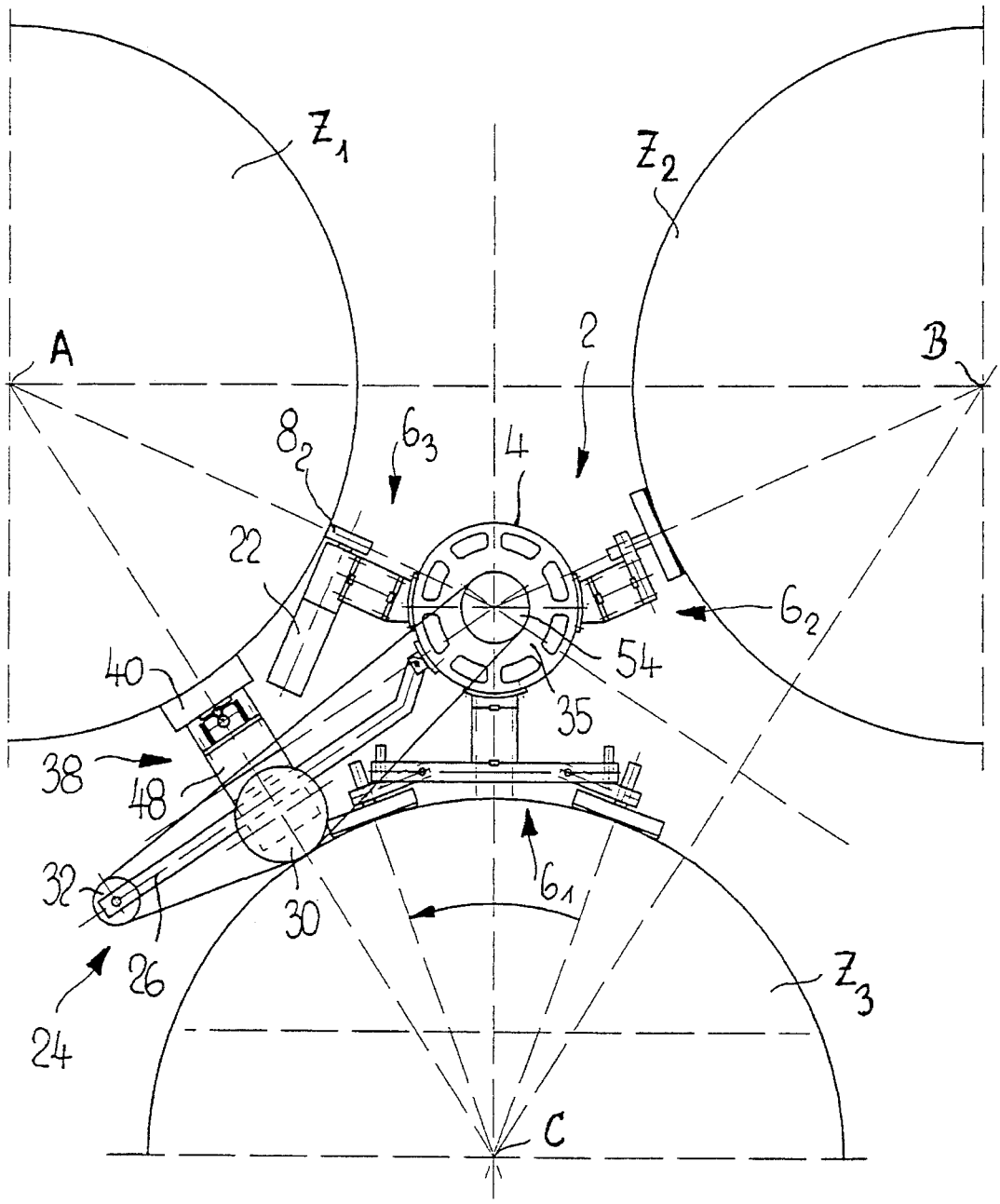
FIG. 2 is a schematic view of a grinding device according to a second embodiment of the present invention, the grinding device being shown between three cylinders, viewed across the direction of travel.
Figure 7:
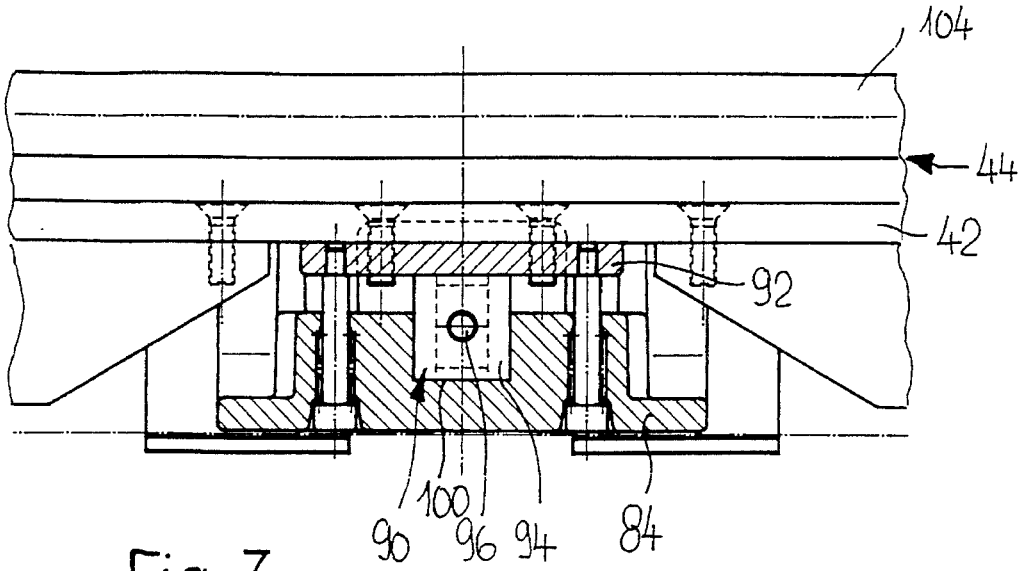
FIG. 7 is a cross-sectional view taken along the line VII—VII in FIG. 6.
Figure 6:
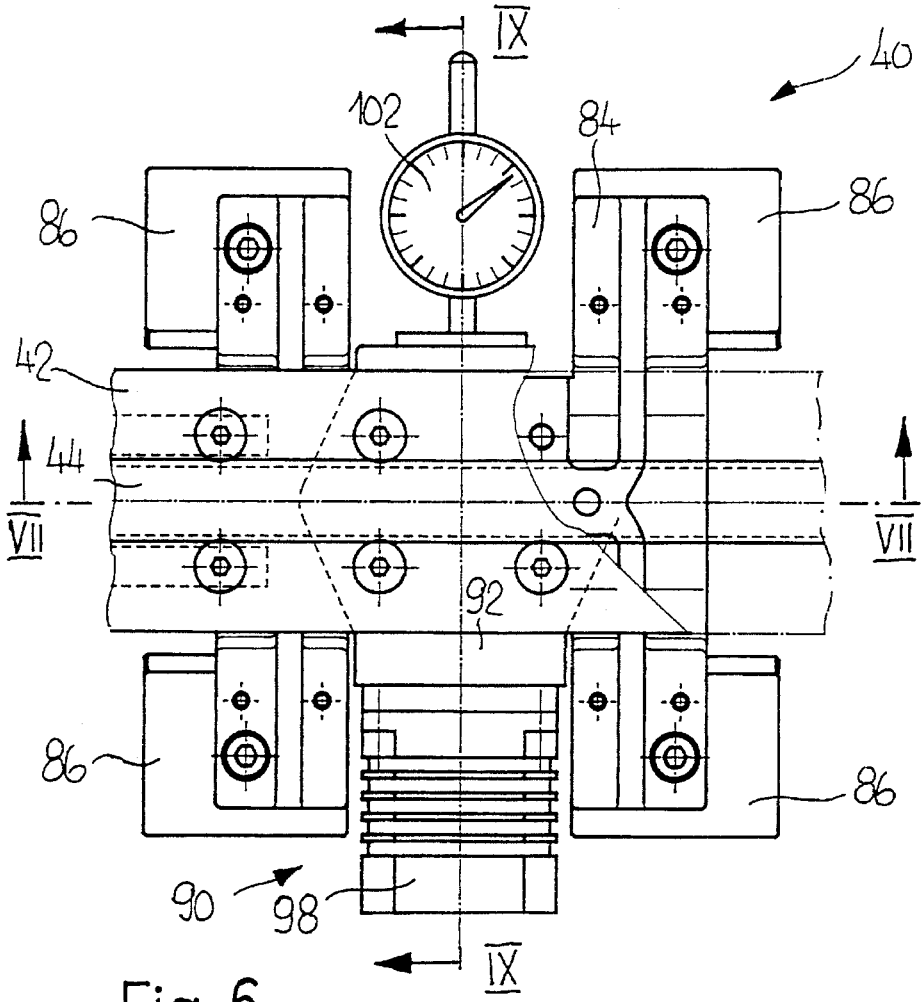
FIG. 6 is a cross-sectional view taken along the line VI—VI in FIG. 1.
Figure 9:
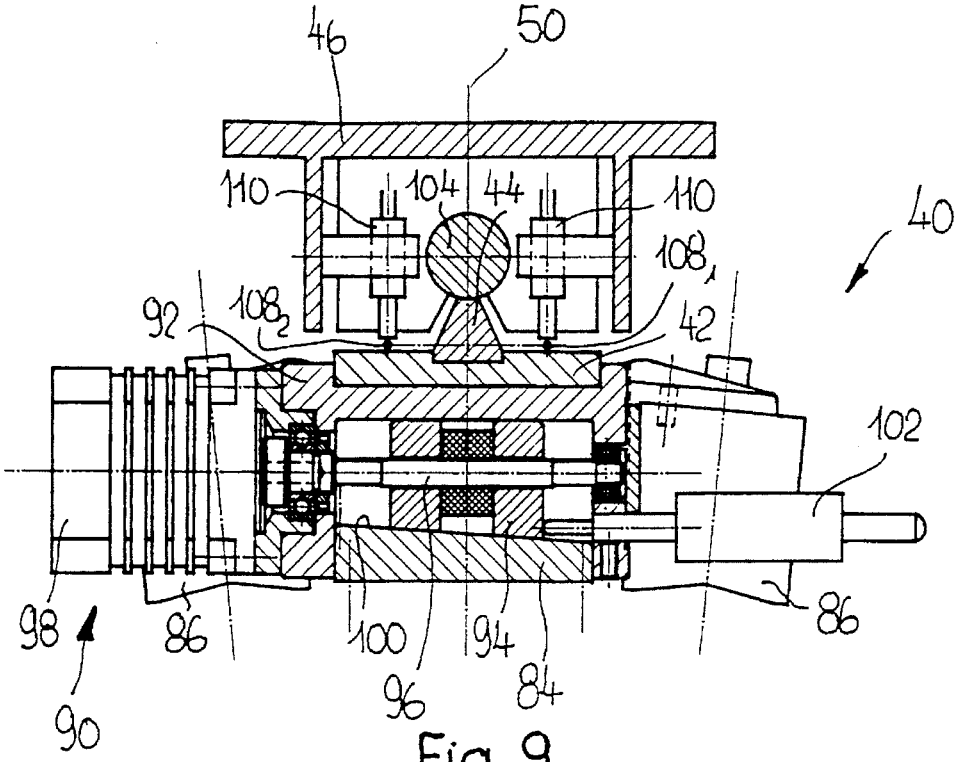
FIG. 9 is a cross-sectional view of the supporting device taken along the line IX—IX in FIG. 6.
Figure 8:
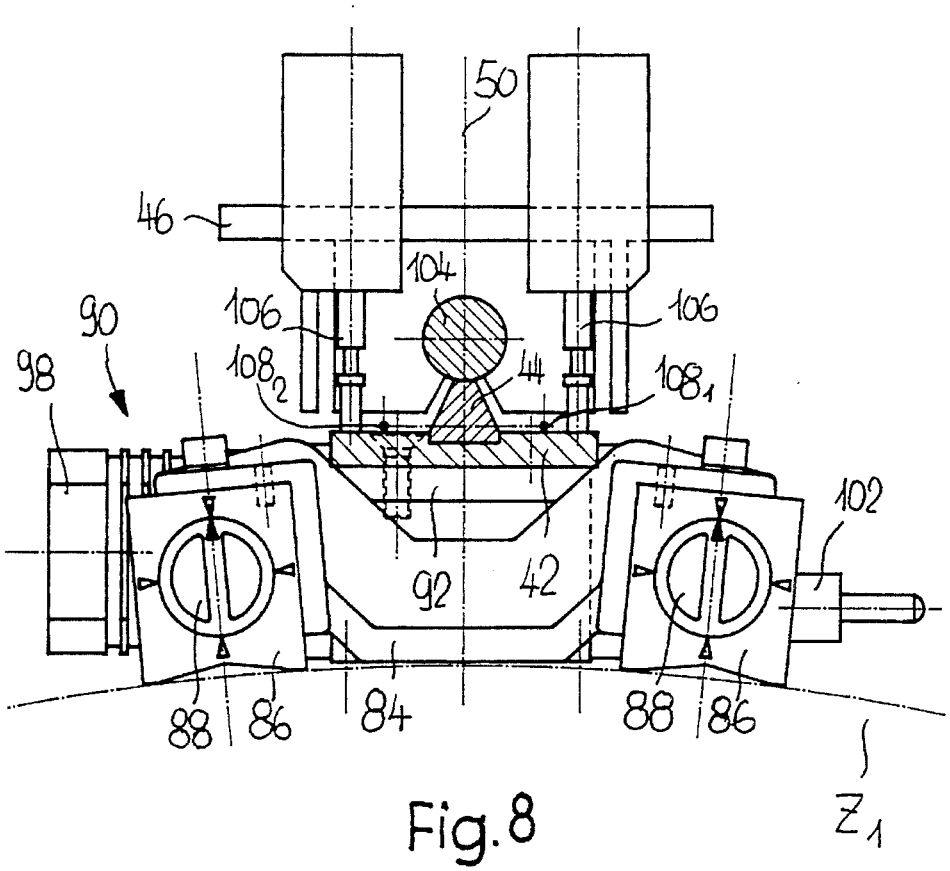
FIG. 8 is an end view of the supporting device according to the embodiment of FIG. 1.

Between the pillow block 28 and the cylinder $Z_1$ serving as support base there is a supporting device 38. The supporting device 38 includes plinth devices 40 which are adjacent the cylinder $Z_1$. The plinth devices 40 carry a guide rule 42 containing a guide rail 44 on which a guide block 46 travels. The guide block 46 is connected to the pillow block 28 of the contact wheel 30 by means of a spacer 48. The spacer 48 can be replaced by other spacers of different sizes so that the length of the supporting device can be adjusted according to the distances $X_1$, $X_2$, $X_3$ from the cylinder surface, as can be seen by comparing the arrangements according to FIG. 1 with that of FIG. 2 or by comparing the arrangement shown in FIG. 4 with that of FIG. 5. The axis 50 of the supporting device 38 is aligned coaxially with the radial beam 52 which connects the axes of the cylinders $Z_1$, $Z_2$.

FIGS. 3 to 5 show further details of the construction of the belt grinder. It can be seen from FIG. 3 that the grinding device has two belt grinders $\mathbf{24}_1$, $\mathbf{24}_2$ which are of identical construction and laterally reversed. Each drive motor 35 is arranged in the central body 4 of the frame 2 and, via a driving wheel 54, drives the abrasive belt 36 which passes over the contact wheel 30 and the guide roller 32. The guide roller 32 is connected to the bracket 26 via a tensioning device 34 which is intimated in the diagram as well as via a corresponding clamping device 56. The guide roll 32 runs in a fork guide 38 and can be pretensioned by means of a piston/cylinder assembly 60.

The pillow block 28 supporting the contact wheel 30 contains an infeed mechanism 62 in order to advance and/or position the contact wheel in relation to the surface of the cylinder to be ground. For this purpose the center arbor 64 of the contact wheel 30 is attached to a slide 66 which can travel on a slide guide 68 of the pillow block 28. An adjusting spindle 74 driven by a drive motor 70 via a belt drive 72 acts in conjunction with the slide 66 and assists the controlled adjustment of the same. The pillow block 28 is connected on one side via a joint or articulation 76 to a clamping device 78 which holds the pillow block 28 on the bracket 26. With the aid of the joint or articulation 76 the pillow block 28 can be swivelled around an axis 80 which runs parallel to the axis of the contact wheel 30. The pillow block 28 is also attached to the spacer 48 of the supporting device 38 and thus rests further on the guide block 46 of the guide rail 44 of the guide rule 42, as already mentioned above. On either side of the slide 66 there are sensors 82 which scan the surface of the supporting base, i.e., of the cylinder surface $Z_2$, and by means of which the radial alignment of the guide device can be determined relative to the radial beam 52. This radial alignment is correct when both sensors 82 show identical readings.

FIG. 5 shows the construction of the supporting device for the smallest possible distance X from the cylinder surface, whereby in this case the pillow block 28 is directly connected to the guide block 46, i.e., no spacer 48 is used.

Further details of the support mechanism are shown in FIGS. 6 to 9. The plinth device 40 includes a base plate 84 to which four magnetic feet 86 are attached. These feet 86 include permanent magnets (not shown in detail) which are switched from inactive status to active status by means of a switch 88 so that the magnetic feet 86 adhere to the supporting base, i.e., the cylinder surface. An adjustable bearing plate 92 is connected via a height adjustment mechanism 90 to the base plate 84 to which the guide rule 42 is attached. The height adjustment mechanism 90 includes a taper key 94 which is connected via a threaded spindle 96 to a servomotor or motor operator 98. The taper key 94 acts in conjunction with an inclined surface 100 on the base plate 84. By actuating the servomotor 98 the taper key 94 can be shifted along the inclined surface 100 thus adjusting the height of the bearing plate 92. The position of the taper key 94 can be determined by means of a dial gauge 102 so that by taking account of the gradient the height and/or any change in the height can be read off. As already mentioned above, the guide rule 42 which carries the guide rail 44 is attached to the bearing plate 92. The guide rail 44 has a rail head 104, preferably with a circular cross section. The previously mentioned guide block 46 can travel on the guide rail 44. On the guide block 46 on either side of the guide rail 44 there are sensors 106 which act in conjunction with the guide rule 42 and determine whether the guide block 46 is aligned correctly around the axis of the rail head 104, i.e., perpendicular to the guide rule 42. It is therefore possible, by turning the cylinder $Z_1$, to align the pillow block 28, and thus the contact wheel 30, around the guide rail 44, preferably in such a way that the axis 50 of the supporting device 38 is aligned perpendicularly to the guide rule 42 and coaxially to the radial beam 52 between the cylinders $Z_1$ and $Z_2$.

If necessary the rail head 104 can also have a polygonal cross section, i.e., can be of a prismatic shape; in this case there has to be an articulated connection in the supporting device 38 enabling it to swivel around an axis lying parallel to the guide rail 44.

In order to align the guide rule 42 on a possibly uneven supporting base, i.e., an uneven cylinder surface, there are two steel wires $\mathbf{108}_1$ and $\mathbf{108}_2$ attached taut to either end of the guide rule and running parallel to the guide rail 44 on either side, and enabling the guide rule to be aligned. For this purpose there are sensors 110 on the guide block 46 on either side of the guide rail 44. The sensors 110 act in conjunction with the steel wires $\mathbf{108}_1$, $\mathbf{108}_2$ and measure the distance of the guide block 46 from the steel wires $\mathbf{108}_1$, $\mathbf{108}_2$. The guide rule is correctly aligned if on the one hand the guide block 46 is aligned radially as described above, and on the other hand if the sensors 110 are equidistant from the steel wires 108 over the entire length of the path of the guide block 46 on the guide rail 44. If the distance varies the guide rule 42 must be adjusted by means of the height adjustment mechanism 90 until the distance is constant over the entire length of the guide rule 42.

Figure 11:
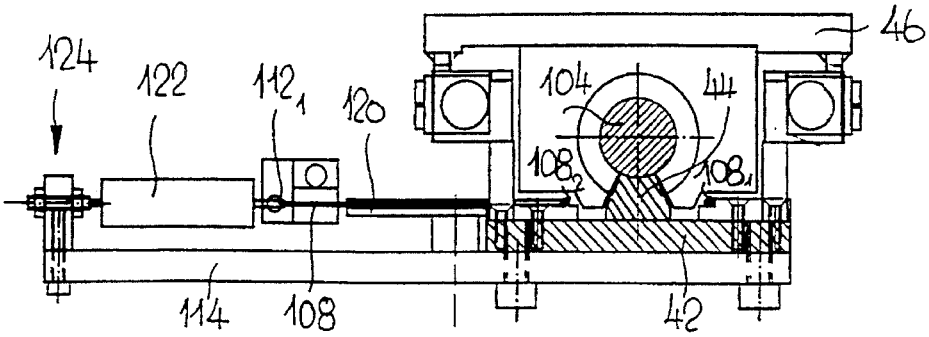
FIG. 11 is a cross-sectional view taken along the line XI—XI in FIG. 10.
Figure 10:
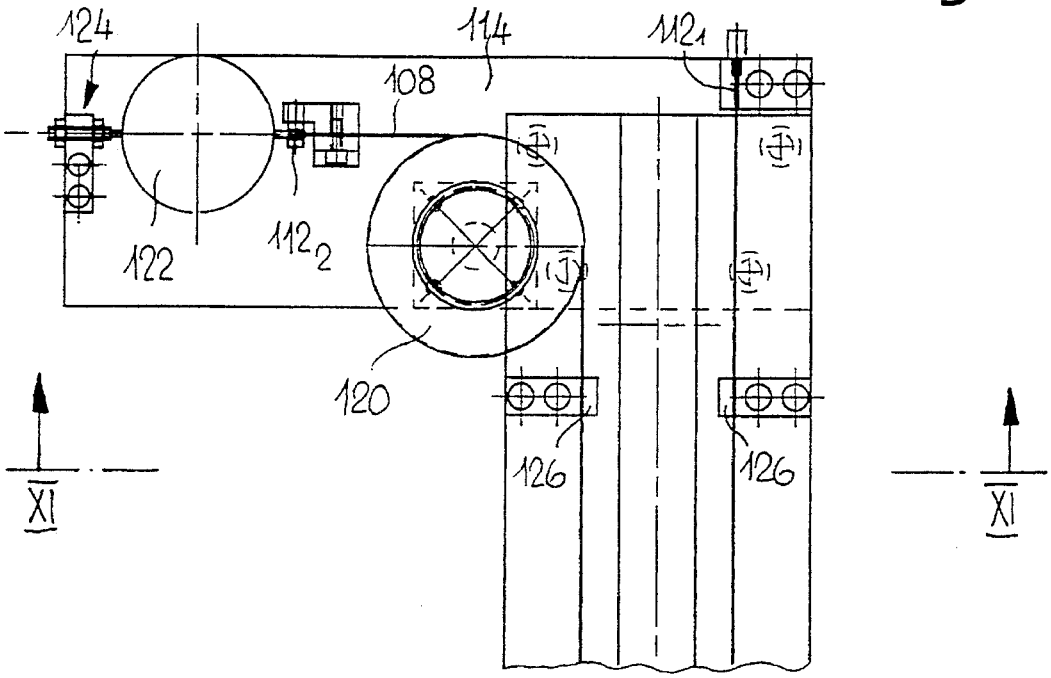
FIG. 10 is a plan view of a portion of the device for arranging and tightening steel cables.
Figure 10:
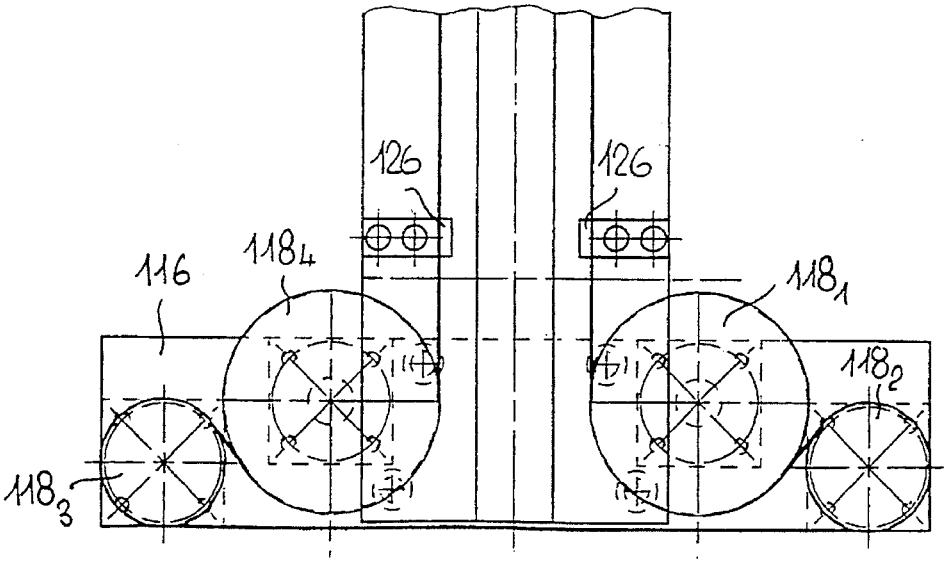

FIGS. 10 and 11 show a device for arranging the steel wires $\mathbf{108}_1$, $\mathbf{108}_2$, which form sections of a continuous steel wire 108, the ends of which are fastened to a first stay 114 which is in its turn firmly attached to one end of the guide rule 42. The steel wire runs the length of the guide rule 42 to the opposite end of the guide rule 42, to which is attached a second stay 116 with guide rollers $\mathbf{118}_1$, $\mathbf{118}_2$, $\mathbf{118}_3$, $\mathbf{118}_4$. The steel wire 108 is taken around the guide rollers $\mathbf{118}_1$, $\mathbf{118}_2$, $\mathbf{118}_3$, $\mathbf{118}_4$ and then runs back along the guide rule 42 to the first stay 116, where it is taken around a further guide roller 120 to a measuring device 122 to which the end $\mathbf{112}_2$ of the steel wire is attached. The measuring device 122 is in turn connected to the first stay 114 via a tensioning device 124. The first end $\mathbf{112}_1$ of the steel wire 108 is attached taut to the first stay 114. By means of the tensioning device 124, the tension of the steel wire 108 can now be changed and the tension of the steel wire can be read off the dial gauge 122. It is thus possible to set the steel wire 108, and hence its sections $\mathbf{108}_1$ and $\mathbf{108}_2$, to optimal and ever-constant tension levels. In the area at either end of the guide rule 42 there are also reference points 126 where the steel wire sections $\mathbf{108}_1$ and $\mathbf{108}_2$ make contact and between which the guide rule 42 can be aligned in the manner described above.

Figure 12:
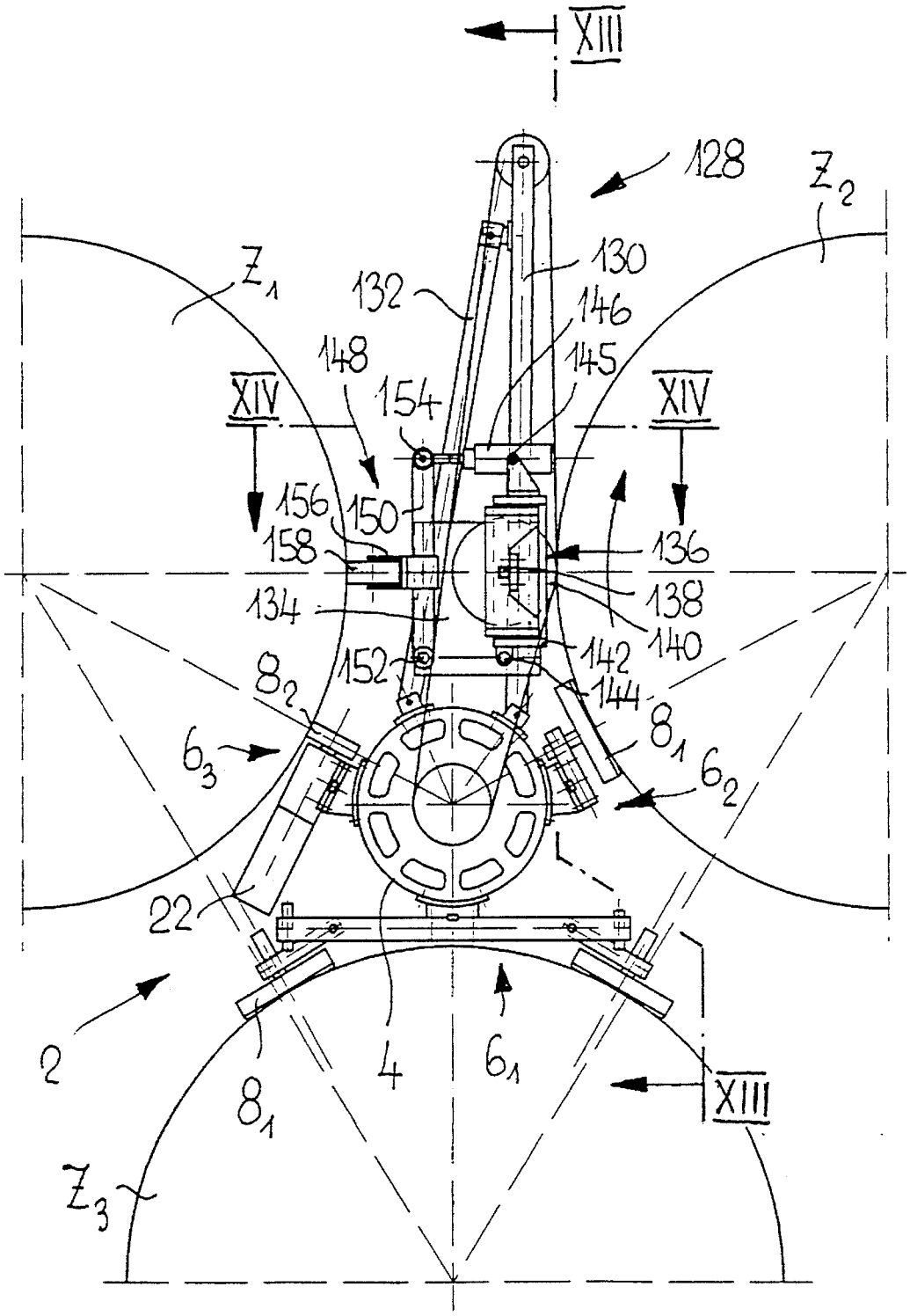
FIG. 12 is a schematic view of a grinding device according to a third embodiment of the present invention.
Figure 13:
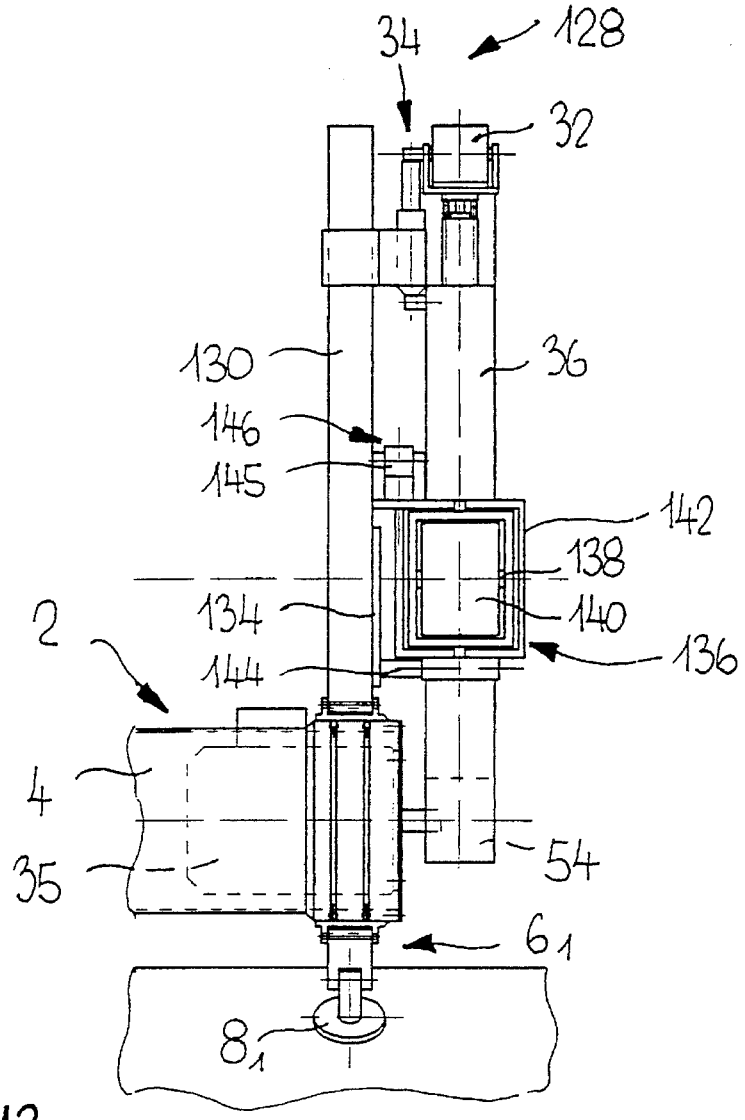
FIG. 13 is a cross-sectional view taken along the line XIII—XIII in FIG. 12.
Figure 14:
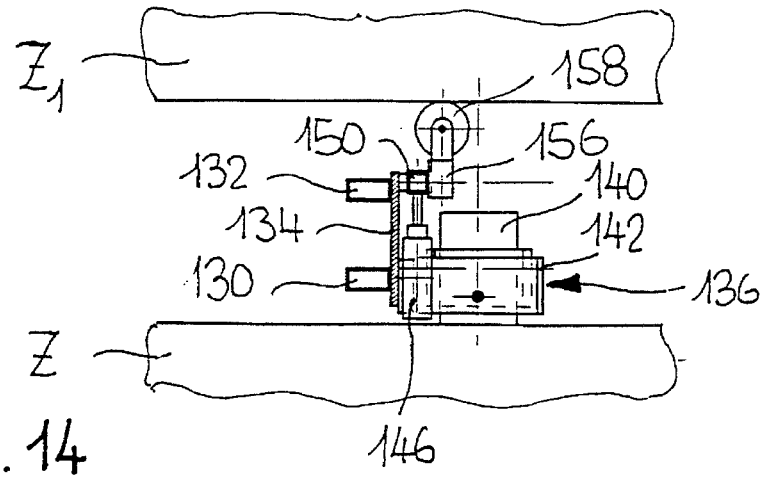
FIG. 14 is a cross-sectional view taken along the line XIV—XIV in FIG. 12.

FIGS. 12 to 14 show a further grinding device, in which the arrangement of the cylinders $Z_1$, $Z_2$, Z3 is identical to the grinding device described above and therefore the same parts are identified by the same reference numbers. The grinding device again includes a frame 2 with a central body 4 on which supporting members $\mathbf{6}_1$, $\mathbf{6}_2$, $\mathbf{6}_3$ are arranged in pairs in the shape of a star, with feet $\mathbf{8}_1$, $\mathbf{8}_2$ resting on a supporting base, i.e., the cylinders $Z_1$, $Z_2$, $Z_3$. For further details and the drive for moving the frame 2 along the cylinder please refer to the description above.

Once again, on the frame there is at least one belt grinder 128, containing a bracket 130 guided on the central body 4; the bracket 130 can no longer be swivelled freely but rests on the central body 4 via a second supporting arm 132 thus forming a triangle with the first supporting arm. The first bracket 130 carries a pillow block 134 which is adjustably attached to the bracket 130 by means of a clamping device, details of which are not shown. The center arbor 138 of the contact wheel 140 runs in a cardanic or universal suspension 136 on the pillow block 134. The outer frame 142 of the cardanic or universal suspension 136 is connected at one end to the pillow block 134 via an articulated joint 144. At the opposite end of the frame 142 there is an infeed mechanism 146 hinged onto the supporting mechanism 148. The supporting mechanism 148 includes a rocker 150, one side of which is attached to the pillow block 134 by means of a joint enabling it to swivel. An opposite end of the rocker 150 is connected via a second joint 154 to the infeed mechanism 146, which may, for example, include a piston/cylinder assembly or an adjusting spindle driven by a motor. Between the joints 152, 154 a pillow block 156 carrying a roller 158 is attached to the rocker 150. The roller 158 acts directly in conjunction with the cylinder $Z_1$. Preferably the connection between the pillow block and the rocker 150 should be adjustable lengthwise in order to allow the belt grinder to adapt to different distances between itself and the cylinder. For this purpose, the previously mentioned spacers or an appropriate adjustable spindle could be used. If necessary the supporting arm 132 can be connected to the bracket 130 in a manner allowing a variable effective length in order to enable the bracket 130, and hence also the supporting arm 132 and the supporting device attached thereto, to be adapted to fit between the cylinders and in particular to be aligned along the radial beam 52.

The contact wheel 140 is driven as described in the example above by means of a drive motor 35 situated in the central body 4, whereby the abrasive belt 36 is taken over the drive wheel 54, the contact wheel 140 and the guide roller 32, and whereby the latter is attached to the bracket 130 by means of a tensioning device 34.

With the aid of the present grinding device it is possible to grind cylinders placed close together very easily, without dismantling the cylinder and with the minimum of effort in assembling the grinding device.

The present invention offers advantages such as facilitating positioning of the frame 2 between the cylinders. Embodiments of the present invention utilizing feet $\mathbf{8}_2$ having wheels minimizes frictional resistance between the feet and an associated cylinder and facilitates smooth movement of the grinding device relative to the cylinders. Moreover, feet $\mathbf{8}_2$ having wheels facilitate movement of the frame 2 between an idle cylinder and a revolving cylinder.

The pillow block 28 or 134 may be attached to the bracket 26 or 130, respectively, through the simple expedient of using the clamping device 78. Moreover, alignment of the contact wheel 30 with the cylinder to be ground is facilitated where the pillow block 28 is connected with the bracket 26 so that the supporting device 38 can be swivelled. However, a floating mounting of a center arbor of the contact wheel 30 may also be used.

Regardless of the quality of a supporting one of the cylinders, the guide arrangement described above, including the guide rule 42 and the guide rail 44, facilitates alignment and guidance of the contact wheel 30 on the surface of the cylinder to be ground. The guide arrangement may be securely fastened to a supporting one of the cylinders by the magnetic feet 86, and the height adjustment mechanism 90 may be used to compensate for irregularities in the surface of the supporting one of the cylinders.

While this invention has been illustrated and described in accordance with a preferred embodiment, it is recognized that variations and changes may be made therein without departing from the invention as set forth in the claims.

What is claimed:

1. A device for grinding a surface of one supporting base of a machine having two or more parallel supporting bases axially offset from one another, the device comprising:

a frame having a central body;

a plurality of supporting members extending outwardly from the central body in positions to engage the supporting bases, the supporting members being arranged to support the central body between the supporting bases and the supporting members travelling on the supporting bases;

at least one belt grinder assembly including a belt grinder, the belt grinder being mounted on the central body by a bracket, the belt grinder including a contact wheel and an abrasive belt extending around the contact wheel, and, attached to the bracket, a pillow block for the contact wheel and a supporting device for being arranged between the pillow block and a one of the supporting bases not being ground to thereby support the contact wheel relative to a one of the supporting bases to be ground, the supporting device being adjustable to permit arrangement of the supporting device between the pillow block and a supporting base not being ground in different machines.

2. The device as set forth in claim 1, wherein the supporting members are each adjustably attached to the central body by spacer means between each supporting member and the central body, a length of the spacer means being adjustable.

3. The device as set forth in claim 1, wherein at least one of the supporting members includes a roller abutting against an associated one of the supporting bases and means for driving the roller.

4. The device as set forth in claim 3, wherein at least one of the supporting members includes a support foot, the support foot having a plurality of air exit orifices, and means for blowing air through the air exit orifices to form an air cushion between the support foot and an associated one of the supporting bases.

5. The device as set forth in claim 1, wherein the pillow block is adjustably attached to the bracket.

6. The device as set forth in claim 1, wherein the pillow block is adjustably attached to the bracket such that the pillow block is pivotable around an axis parallel to an axis of the contact wheel.

7. The device as set forth in claim 1, wherein the belt grinder assembly includes means for driving the abrasive belt, the driving means being disposed in the central body.

8. A device for grinding a surface of one supporting base of a machine having two or more parallel supporting bases axially offset from one another, the device comprising:

a frame having a central body;

a plurality of supporting members extending outwardly from the central body in positions to engage the supporting bases, the supporting members being arranged to support the central body between the supporting bases;

at least one belt grinder assembly including a belt grinder and means for mounting the belt grinder on the central body, the belt grinder including a contact wheel and an abrasive belt extending around the contact wheel, and means for supporting the contact wheel relative to a one of the supporting bases to be ground, wherein at least one of the supporting members includes a support foot, the support foot having a plurality of air exit orifices, and means for blowing air through the air exit orifices to form an air cushion between the support foot and an associated one of the supporting bases.

9. A device for grinding a surface of one supporting base of a machine having two or more parallel supporting bases axially offset from one another, the device comprising:

a frame having a central body;

a plurality of supporting members extending outwardly from the central body in positions to engage the supporting bases, the supporting members being arranged to support the central body between the supporting bases;

at least one belt grinder assembly including a belt grinder and means for mounting the belt grinder on the central body, the belt grinder including a contact wheel and an abrasive belt extending around the contact wheel, and means for supporting the contact wheel relative to a one of the supporting bases to be ground, wherein the supporting means is adjustably attached to the mounting means such that the supporting means is pivotable around an axis parallel to an axis of the contact wheel, and the contact wheel includes a central arbor, the central arbor being attached to the supporting means by a universal suspension device.

10. A device for grinding a surface of one supporting base of a machine having two or more parallel supposing bases axially offset from one another, the device comprising:

a frame having a central body;

a plurality of supporting members extending outwardly from the central body in positions to engage the supporting bases, the supporting members being arranged to support the central body between the supporting bases;

at least one belt grinder assembly including a belt grinder and means for mounting the belt grinder on the central body, the belt grinder including a contact wheel and an abrasive belt extending around the contact wheel, and means for supporting the contact wheel relative to a one of the supporting bases to be ground, wherein the supporting means extends substantially between the supporting base that is to be ground and a second one of the supporting bases, the supporting means including a roller for contacting the second one of the supporting bases, the roller having an axis perpendicular to the second one of the supporting bases.

11. The device as set forth in claim 10, wherein the contact wheel includes a central arbor, the central arbor being attached to the supporting means by a universal suspension device, the supporting means includes a rocker, the roller of the supporting means being attached to the rocker, the rocker having a first and a second end, the universal suspension device having a first and a second end, the first end of the universal suspension device being attached to the rocker by a pillow block, the second end of the universal suspension device being attached to the rocker by an infeed mechanism, the infeed mechanism being adjustable in length.

12. A device for grinding a surface of one supporting base of a machine having two or more parallel supporting bases axially offset from one another, the device comprising:

a frame having a central body;

a plurality of supporting members extending outwardly from the central body in positions to engage the supporting bases, the supporting members being arranged to support the central body between the supporting bases;

at least one belt grinder assembly including a belt grinder and means for mounting the belt grinder on the central body, the belt grinder including a contact wheel and an abrasive belt extending around the contact wheel, and means for supporting the contact wheel relative to a one of the supporting bases to be ground, wherein the supporting means extends substantially between the supporting base that is to be ground and a second one of the supporting bases and includes a plinth member, the plinth member including means for connecting the plinth member to the second one of the supporting bases.

13. The device as set forth in claim 12, wherein the connecting means includes one or more magnetizable feet.

14. The device as set forth in claim 12, wherein the device includes a second belt grinder assembly and a guide assembly for the belt grinder assemblies, the guide assembly forming a part of the supporting means for each belt grinder assembly, and, for each belt grinder assembly, the guide assembly is attached to the plinth member, the guide assembly including a guide rail extending substantially parallel to the second one of the supporting bases and a guide block pivotably attached to the guide rail, the guide block being movable along at least a portion of the length of the guide rail, the guide block being attachable to at least one of the contact wheel and a spacer device removably attached between the guide block and the contact wheel.

15. The device as set forth in claim 14, wherein the guide block is aligned along an axis of the supporting means, the axis of the supporting means being disposed in a plane extending between a central axis of the supporting base that is to be ground and a central axis of the second one of the supporting bases, and the supporting means includes means for detecting misalignment of the guide block.

16. The device as set forth in claim 15, wherein, for each belt grinder assembly, the supporting means includes means for adjusting a position of the guide assembly relative to the connecting means such that misalignment of the guide block detected by the detecting means is corrected.

17. The device as set forth in claim 15, wherein the detecting means includes one or more wires on opposite sides of the guide block, the wires extending parallel to the guide rail, and sensors attached to the opposite sides of the guide block for sensing a distance of the opposites sides of the guide block from the wires.

18. The device as set forth in claim 17, wherein the wires on opposite sides of the guide block are sections of a single wire, and wherein the detecting means includes means for detecting tension in the single wire and means, responsive to the tension detecting means, for maintaining a constant tension in the single wire.

19. The device as set forth in claim 12, wherein an axis of the supporting means is disposed in a plane extending between a central axis of the supporting base that is to be ground and a central axis of the second one of the supporting bases, the contact wheel being associated with sensor means for sensing whether the axis of the supporting means is aligned with the plane.

20. The device as set forth in claim 19, wherein the sensor means includes upper and lower sensors connected to the contact wheel above and below the contact wheel, the upper and lower sensors each including means for measuring a distance to the supporting base that is to be ground.

21. The device as set forth in claim 20, wherein the upper and lower sensors are connected to the contact wheel such that the supporting means is properly aligned with the plane when distances measured by the upper and lower sensors are the same.

* * * * *